US006424938B1

(12) United States Patent
Johansson et al.

(10) Patent No.: US 6,424,938 B1
(45) Date of Patent: Jul. 23, 2002

(54) COMPLEX SIGNAL ACTIVITY DETECTION FOR IMPROVED SPEECH/NOISE CLASSIFICATION OF AN AUDIO SIGNAL

(75) Inventors: Ingemar Johansson, Luleå; Erik Ekudden, Åkersberga; Jonas Svedberg; Anders Uvliden, both of Luleå, all of (SE)

(73) Assignee: Telefonaktiebolaget L M Ericsson, Stockholm (SE)

( * ) Notice: Subject to any disclaimer, the term of this patent is extended or adjusted under 35 U.S.C. 154(b) by 0 days.

(21) Appl. No.: 09/434,787

(22) Filed: Nov. 5, 1999

Related U.S. Application Data

(60) Provisional application No. 60/109,556, filed on Nov. 23, 1998.

(51) Int. Cl.[7] ..... G10L 19/08

(52) U.S. Cl. ..... 704/216; 704/220; 704/224; 704/226

(58) Field of Search ..... 704/214, 216, 704/220, 224, 226, 230

(56) References Cited

U.S. PATENT DOCUMENTS

| | | | | | |
|---|---|---|---|---|---|
| 5,276,765 | A | * | 1/1994 | Freeman et al. | 704/200 |
| 5,414,796 | A | * | 5/1995 | Jacobs et al. | 704/221 |
| 5,657,420 | A | * | 8/1997 | Jacobs et al. | 704/223 |
| 6,097,772 | A | * | 8/2000 | Johnson et al. | 375/346 |
| 6,104,992 | A | * | 8/2000 | Gao et al. | 704/220 |
| 6,173,257 | B1 | * | 1/2001 | Gao | 704/220 |
| 6,188,980 | B1 | * | 2/2001 | Thyssen | 704/230 |
| 6,240,386 | B1 | * | 5/2001 | Thyssen et al. | 704/220 |
| 6,260,010 | B1 | * | 7/2001 | Gao | 704/230 |

* cited by examiner

*Primary Examiner*—Richemond Dorvil
*Assistant Examiner*—Susa McFadden
(74) *Attorney, Agent, or Firm*—Jenkens & Gilchrist, P.C.

(57) ABSTRACT

Perceptually relevant non-speech information can be preserved during encoding of an audio signal by determining whether the audio signal includes such information. If so, a speech/noise classification of the audio signal is overriden to prevent misclassification of the audio signal as noise.

20 Claims, 9 Drawing Sheets

COMPLEX SIGNAL ACTIVITY DETECTION FOR IMPROVED SPEECH/NOISE CLASSIFICATION OF AN AUDIO SIGNAL

This application claims the priority under 35 USC 119 (e)(1) of U.S. Provisional Application No. 60/109,556, filed on Nov. 23, 1998.

FIELD OF THE INVENTION

The invention relates generally to audio signal compression and, more particularly, to speech/noise classification during audio compression.

BACKGROUND OF THE INVENTION

Speech coders and decoders are conventionally provided in radio transmitters and radio receivers, respectively, and are cooperable to permit speech (voice) communications between a given transmitter and receiver over a radio link. The combination of a speech coder and a speech decoder is often referred to as a speech codec. A mobile radiotelephone (e.g., a cellular telephone) is an example of a conventional communication device that typically includes a radio transmitter having a speech coder, and a radio receiver having a speech decoder.

In conventional block-based speech coders the incoming speech signal is divided into blocks called frames. For common 4 kHz telephony bandwidth applications a typical framelength is 20 ms or 160 samples. The frames are further divided into subframes, typically of length 5 ms or 40 samples.

In compressing the incoming audio signal, speech encoders conventionally use advanced lossy compression techniques. The compressed (or coded) signal information is transmitted to the decoder via a communication channel such as a radio link. The decoder then attempts to reproduce the input audio signal from the compressed signal information. If certain characteristics of the incoming audio signal are known, then the bit rate in the communication channel can be maintained as low as possible. If the audio signal contains relevant information for the listener, then this information should be retained. However, if the audio signal contains only irrelevant information (for example background noise), then bandwidth can be saved by only transmitting a limited amount of information about the signal. For many signals which contain only irrelevant information, a very low bit rate can often provide high quality compression. In extreme cases, the incoming signal may be synthesized in the decoder without any information updates via the communication channel until the input audio signal is again determined to include relevant information.

Typical signals which can be conventionally reproduced quite accurately with very low bit rates include stationary noise, car noise and also, to some extent, babble noise. More complex non-speech signals like music, or speech and music combined, require higher bit rates to be reproduced accurately by the decoder.

For many common types of background noise a much lower bit rate than is needed for speech provides a good enough model of the signal. Existing mobile systems make use of this fact by downwardly adjusting the transmitted bit rate during background noise. For example, in conventional systems using continuous transmission techniques, a variable rate (VR) speech coder may use its lowest bit rate.

In conventional Discontinuous Transmission (DTX) schemes, the transmitter stops sending coded speech frames when the speaker is inactive. At regular or irregular intervals (for example, every 100 to 500 ms), the transmitter sends speech parameters suitable for conventional generation of comfort noise in the decoder. These parameters for comfort noise generation (CNG) are conventionally coded into what are sometimes called Silence Descriptor (SID) frames. At the receiver, the decoder uses the comfort noise parameters received in the SID frames to synthesize artificial noise by means of a conventional comfort noise injection (CNI) algorithm.

When comfort noise is generated in the decoder in a conventional DTX system, the noise is often perceived as being very static and much different from the background noise generated in active (non-DTX) mode. The reason for this perception is that DTX SID frames are not sent to the receiver as often as normal speech frames. In conventional linear prediction analysis-by-synthesis (LPAS) codecs having a DTX mode, the spectrum and energy of the background noise are typically estimated over several frames (for example, averaged), and the estimated parameters are then quantized and transmitted in SID frames over the channel to the decoder.

The benefit of sending the SID frames with their relatively low update rate instead of sending regular speech frames is twofold. The battery life in, for example, a mobile radio transceiver, is extended due to lower power consumption, and the interference created by the transmitter is lowered, thereby providing higher system capacity.

If a complex signal like music is compressed using a compression model that is too simple, and a corresponding bit rate that is too low, the reproduced signal at the decoder will differ dramatically from the result that would be obtained using a better (higher quality) compression technique. The use of a too simple compression scheme can be caused by misclassifying the complex signal as noise. When such misclassification occurs, not only does the decoder output a poorly reproduced signal, but the misclassification itself disadvantageously results in a switch from a higher quality compression scheme to a lower quality compression scheme. To correct the misclassification, another switch back to the higher quality scheme is needed. If such switching between compression schemes occurs frequently, it is typically very audible and can be irritating to the listener.

It can be seen from the foregoing that it is desirable to reduce the misclassification of subjectively relevant signals, while still maintaining a low bit rate (high compression) where appropriate, for example when compressing background noise while the speaker is silent. Very strong compression techniques can be used, provided they are not perceived as irritating. The use of comfort noise parameters as described above with respect to DTX systems is an example of a strong compression technique, as is conventional low rate linear predictive coding (LPC) using random excitation methods. Coding techniques such as these, which utilize strong compression, can typically reproduce accurately only perceptually simple noise types such as stationary car noise, street noise, restaurant noise (babble) and other similar signals.

Conventional classification techniques for determining whether or not an input audio signal contains relevant information are primarily based on a relatively simple stationarity analysis of the input audio signal. If the input signal is determined to be stationary, then it is assumed to be a noise-like signal. However, this conventional stationarity analysis alone can cause complex signals that are fairly stationary but actually contain perceptually relevant information to be misclassified as noise. Such a misclassification disadvantageously results in the problems described above.

It is therefore desirable to provide a classification technique that reliably detects the presence of perceptually relevant information in complex signals of the type described above.

According to the present invention, complex signal activity detection is provided for reliably detecting complex non-speech signals that include relevant information that is perceptually important to the listener. Examples of complex non-speech signals that can be reliably detected include music, music on-hold, speech and music combined, music in the background, and other tonal or harmonic sounds.

DETAILED DESCRIPTION

Figure 1:
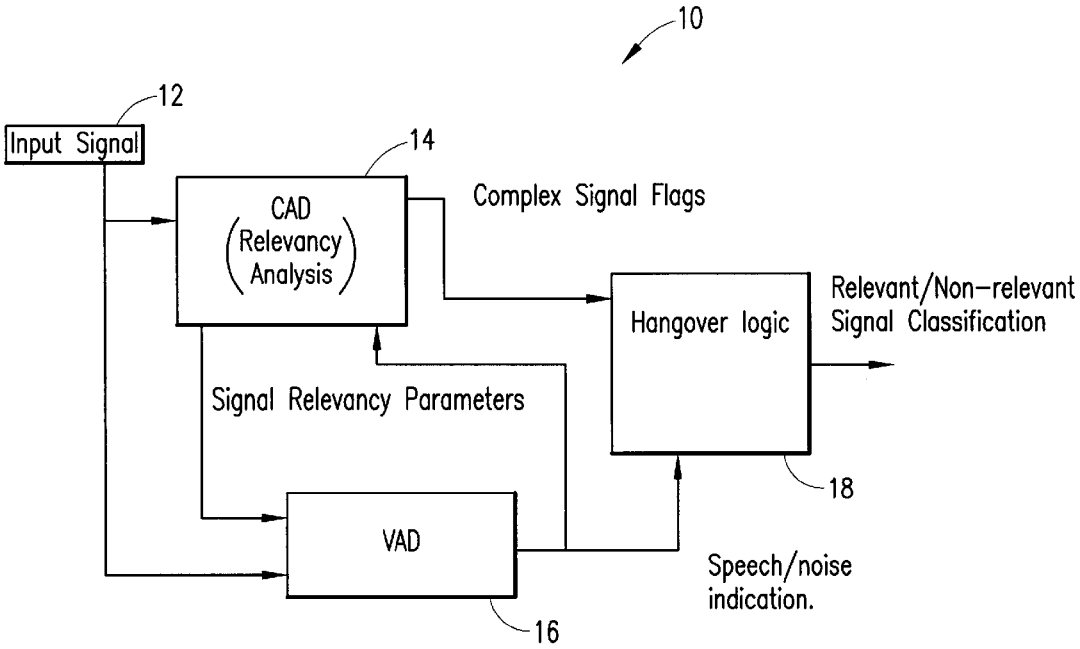
FIG. 1 diagrammatically illustrates pertinent portions of an exemplary speech encoding apparatus according to the invention.

FIG. 1 diagrammatically illustrates pertinent portions of exemplary embodiments of a speech encoding apparatus according to the invention. The speech encoding apparatus can be provided, for example, in a radio transceiver that communicates audio information via a radio communication channel. One example of such a radio transceiver is a mobile radiotelephone such as a cellular telephone.

In FIG. 1, the input audio signal is input to a complex signal activity detector (CAD) and also to a voice activity detector (VAD). The complex signal activity detector CAD is responsive to the audio input signal to perform a relevancy analysis that determines whether the input signal includes information that is perceptually relevant to the listener, and provide a set of signal relevancy parameters to the VAD. The VAD uses these signal relevancy parameters in conjunction with the received audio input signal in order to determine whether the input audio signal is speech or noise. The VAD operates as a speech/noise classifier; and provides as an output a speech/noise indication. The CAD receives the speech/noise indication as an input. The CAD is responsive to the speech/noise indication and the input audio signal to produce a set of complex signal flags which are output to a hangover logic section which also receives as an input the speech/noise indication provided by the VAD.

The hangover logic is responsive to the complex signal flags and the speech/noise indication for providing an output which indicates whether or not the input audio signal includes information which is perceptually relevant to a listener who will hear a reproduced audio signal output by a decoding apparatus in a receiver at the other end of the communication channel. The output of the hangover logic can be used appropriately to control, for example, DTX operation (in a DTX system) or the bit rate (in a variable rate VR encoder). If the hangover logic output indicates that input audio signal does not contain relevant information, then comfort noise can be generated (in a DTX system) or the bit rate can be lowered (in a VR encoder).

The input signal (which can be preprocessed) is analyzed in the CAD by extracting information each frame about the correlation of the signal in a specific frequency band. This can be accomplished by first filtering the signal with a suitable filter, e.g., a bandpass filter or a high pass filter. This filter weighs the frequency bands which contain most of the energy of interest in the analysis. Typically, the low frequency region should be filtered out in order to de-emphasize the strong low frequency contents of, e.g., car noise. The filtered signal can then be passed to an open-loop long term prediction (LTP) correlation analysis. The LTP analysis provides as a result a vector of correlation values or normalized gain values; one value per correlation shift. The shift range may be, for example, [20, 147] as in conventional LTP analysis. An alternative, low complexity, method to achieve the desired relevancy detection is to use the unfiltered signal in the correlation calculation and modify the correlation values by an algorithmically similar "filtering" process, as described in detail below.

For each analysis frame, the normalized correlation value (gain value) having the largest magnitude is selected and buffered. The shift (corresponding to the LTP lag of the selected correlation value) is not used. The values are further analyzed to provide a vector of Signal Relevancy Parameters which is sent to the VAD for use by the background noise estimation process. The buffered correlation values are also processed and used to make a definitive decision as to whether the signal is relevant (i.e., has perceptual importance) and whether the VAD decision is reliable. A set of flags, VAD_fail_long and VAD_fail_short, are produced to indicate when it is likely that the VAD will make a severe misclassification, that is, a noise classification when perceptually relevant information is in fact present.

The signal relevancy parameters computed in the CAD relevancy analysis are used to enhance the performance of the VAD scheme. The VAD scheme is trying to determine if the signal is a speech signal (possibly degraded by environment noise) or a noise signal. To be able to distinguish the speech+noise signal from the noise, the VAD conventionally keeps an estimate of the noise. The VAD has to update its own estimates of the background noise to make a better decision in the speech+noise signal classification. The relevancy parameters from the CAD are used to determine to what extent the VAD background noise and activity signal estimates are updated.

The hangover logic adjusts the final decision of the signal using previous information on the relevancy of the signal and the previous VAD decisions, if the VAD is considered to be reliable. The output of the hangover logic is a final decision on whether the signal is relevant or non-relevant. In the non-relevant case a low bit rate can be used for encoding. In a DTX system this relevant/non-relevant information is used to decide whether the present frame should be coded in the normal way (relevant) or whether the frame should be coded with comfort noise parameters (non-relevant) instead.

In one exemplary embodiment, an efficient low complexity implementation of the CAD is provided in a speech coder that uses linear prediction analysis-by-synthesis (LPAS) structure. The input signal to the speech coder is conditioned by conventional means (high pass filtered, scaled, etc.). The conditioned signal, s(n), is then filtered by the conventional adaptive noise weighting filter used by LPAS coders. The weighted speech signal, sw(n), is then passed to the open-loop LTP analysis. The LTP analysis calculates and stores the correlation values for each shift in the range [Lmin, Lmax] where, for example, Lmin=18 and Lmax=147. For each lag value (shift), L, in the range the correlation Rxx(k,l) for lag value l is calculated as:

$$Rxx(k=0,l)=\sum_{n=0}^{n=K-1} sw(n-k)sw(n-l) \quad \text{(Equation 1)}$$

where K is the length of the analysis frame. If k is set to zero this may be written as a function only dependent on the lag l:

$$Rxx(l)=\sum_{n=0}^{n=K-1} sw(n)sw(n-l) \quad \text{(Equation 2)}$$

Also one may define $$Exx(L)=Rxx(L,L) \quad \text{(Equation 3)}$$

These procedures are conventionally performed as a pre-search for the adaptive codebook search in the LPAS coder, and are thus available at no extra computational cost.

The optimal gain factor, g_opt, for a single tap predictor is obtained by minimizing the distortion, D, in the equation:

$$D(l)=\sum_{n=0}^{n=N-1} (sw(n)-g\cdot sw(n-l))^2 \quad \text{(Equation 4)}$$

The optimal gain factor g_opt (really the normalized correlation) is the value of g in Equation 4 that minimizes D, and is given by:

$$g_opt=\frac{Rxx(L)}{Exx(L)} \quad \text{(Equation 5)}$$

where L is the lag for which the distortion D (Equation 4) is minimized, and Exx(L) is the energy. The complex signal detector, calculates the optimal gain (g_opt) of a high pass filtered version of the weighted signal sw. The high pass filter can be, for example, a simple first order filter with filter coefficients [h0,h1]. In one embodiment, instead of high pass filtering the weighted signal prior to correlation calculation, a simplified formula minimizes D (see Equation 4) using the filtered signal sw_f(n).

The high pass filtered signal sw_f(n) is given by:

$$sw_f(n)=h0\cdot sw(n)+h1\cdot sw(n-1) \quad \text{(Equation 7)}$$

In this case g_max (the g_opt of the filtered signal) is obtained as:

$$g_max=\frac{Rxx(L)(h0^2+h1^2)+Rxx(L-1)h0h1+Rxx(L+l)h0h1}{Exx(L)(h0^2+h1^2)+Rxx(L,L+1)h0h1+Rxx(L,L-1)h0h1} \quad \text{(Equation 8)}$$

The parameter g_max can thus be computed according to Equation 8 using the aforementioned already available Rxx and Exx values obtained from the unfiltered signal sw, instead of computing a new Rxx for the filtered signal sw_f.

If the filter coefficients [h0, h1] are selected as [1, −1] and the denominator normalizing lag Lden is set to Lden=0, the g_max calculation reduces to:

$$g_max=\frac{2Rxx(L)-(Rxx(L-1)+Rxx(L+1))}{2Exx(Lden)-2Rxx(Lden+1)} \quad \text{(Equation 9)}$$

A further simplification is obtained by using the values for Lden=(Lmin+1) (instead of the optimal L_opt, i.e., the optimal lag in Equation 4) in the denominator of equation (8), and limiting the maximum L to Lmax−1 and the minimum Lmin value in the maximum search to (Lmin+1) In this case no extra correlation calculations are required other than the already available Rxx(l) values from the open-loop LTP analysis.

For each frame, the gain value g_max having the largest magnitude is stored. A smoothed version g_f(i) can be obtained by filtering the g_max value obtained each frame according to g_f(i)=b0·g_max(i)−a1·g_f(i−1). In some embodiments, the filter coefficients b0 and a1 can be time variant, and can also be state and input dependent to avoid state saturation problems. For example, b0 and a1 can be expressed as respective functions of time, g_max(i) and g_f(i−1). That is, b0=$f_b$(t, g_max(i), g_f(i−1)) and a1=$f_a$(t, g_max(i), g_f(i−1)).

The signal g_f(i) is a primary product of the CAD relevancy analysis. By analyzing the state and history of g_f(i), the VAD adaptation can be provided with assistance, and the hangover logic block is provided with operation indications.

Figure 2:
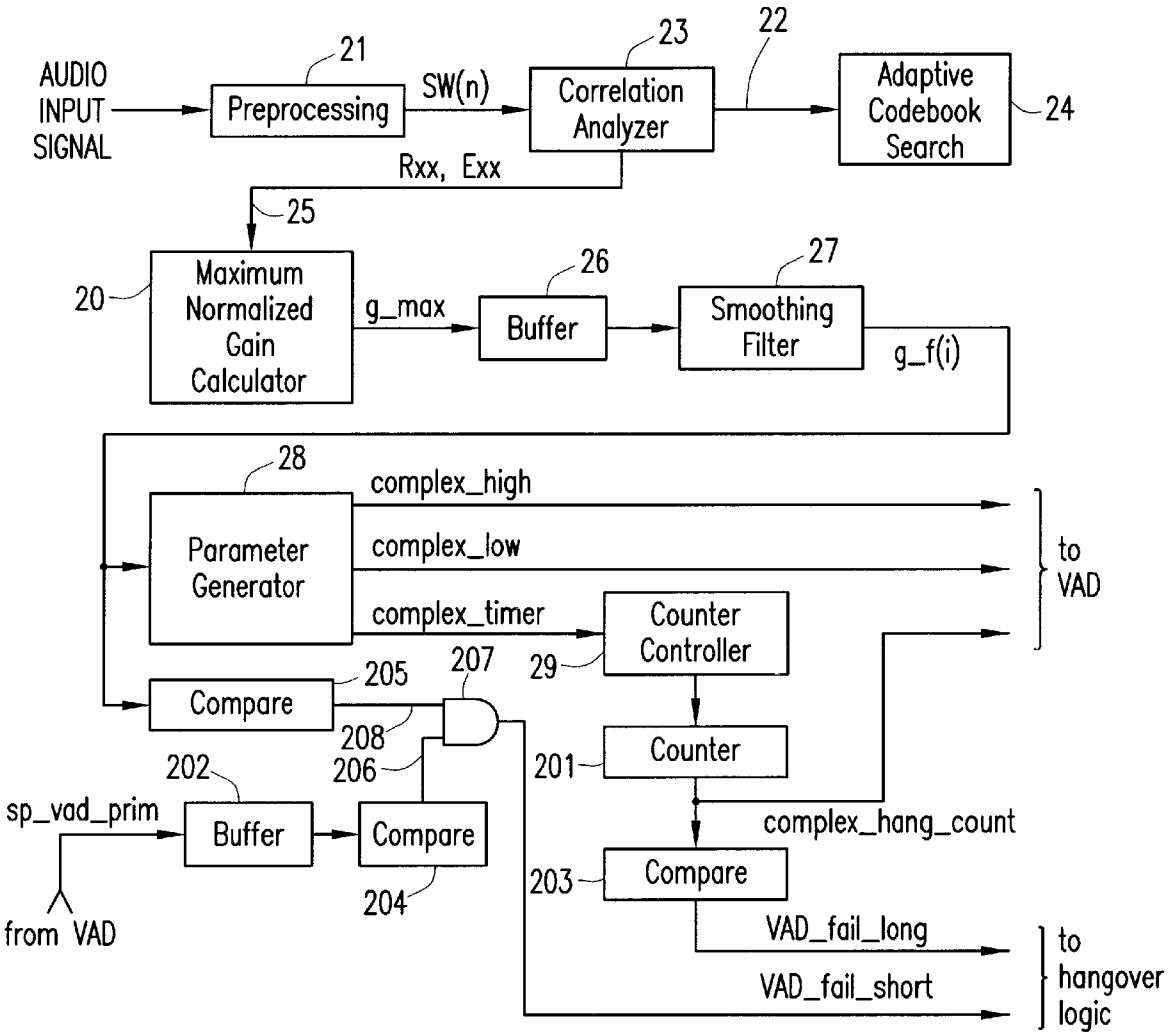
FIG. 2 illustrates exemplary embodiments of the complex signal activity detector of FIG. 1.

FIG. 2 illustrates exemplary embodiments of the above-described complex signal activity detector CAD of FIG. 1. A preprocessing section 21 preprocesses the input signal to produce the aforementioned weighted signal sw(n). The signal sw(n) is applied to a conventional correlation analyzer 23, for example an open-loop long term prediction (LTP) correlation analyzer. The output 22 of the correlation analyzer 23 is conventionally provided as an input to an adaptive codebook search at 24. As mentioned above, the Rxx and Exx values used in the conventional correlation analyzer 23 are available to be used in calculating g_f(i) according to the invention.

The Rxx and Exx values are provided at 25 to a maximum normalized gain calculator 20 which calculates g_max values as described above. The largest-magnitude (maximum-magnitude) g_max value for each frame is selected by calculator 20 and stored in a buffer 26. The buffered values are then applied to a smoothing filter 27 as described above. The output of the smoothing filter 27 is g_f(i).

The signal g_f(i) is input to a parameter generator 28. The parameter generator 28 produces in response to the input signal g_f(i) a pair of outputs complex_high and complex_low which are provided as signal relevancy parameters to the VAD (see FIG. 1). The parameter generator 28 also produces a complex_timer output which is input to a counter controller 29 that controls a counter 201. The output of counter 201, complex_hang_count, is provided to the VAD as a signal relevancy parameter, and is also input to a comparator 203 whose output, VAD_fail_long, is a complex signal flag that is provided to the hangover logic (see FIG. 1). The signal g_f(i) is also provided to a further comparator 205 whose output 208 is coupled to an input of an AND gate 207.

The complex signal activity detector of FIG. 2 also receives the speech/noise indication from the VAD (see FIG. 1), namely the signal sp_vad_prim (e.g., =0 for noise, =1 for speech). This signal is input to a buffer 202 whose output is coupled to a comparator 204. An output 206 of the comparator 204 is coupled to a further input of the AND gate 207. The output of AND gate 207 is VAD_fail_short, a complex signal flag that is input to the hangover logic of FIG. 1.

Figure 13:
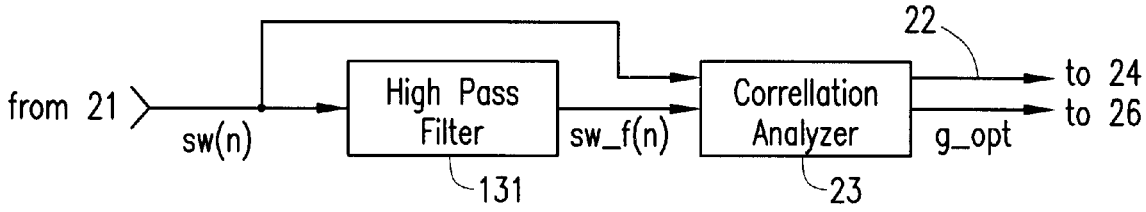
FIG. 13 illustrates alternative embodiments of the complex signal activity detector of FIG. 2.

FIG. 13 illustrates an exemplary alternative to the FIG. 2 arrangement, wherein g_opt values of Equation 5 above are calculated by correlation analyzer 23 from a high-pass filtered version of sw(n), namely sw_f(n) output from high pass filter 131. The largest-magnitude g_opt value for each frame is then buffered at 26 in FIG. 2 instead of g_max. The correlation analyzer 23 also produces the conventional output 22 from the signal sw_(n) as in FIG. 2.

Figure 3:
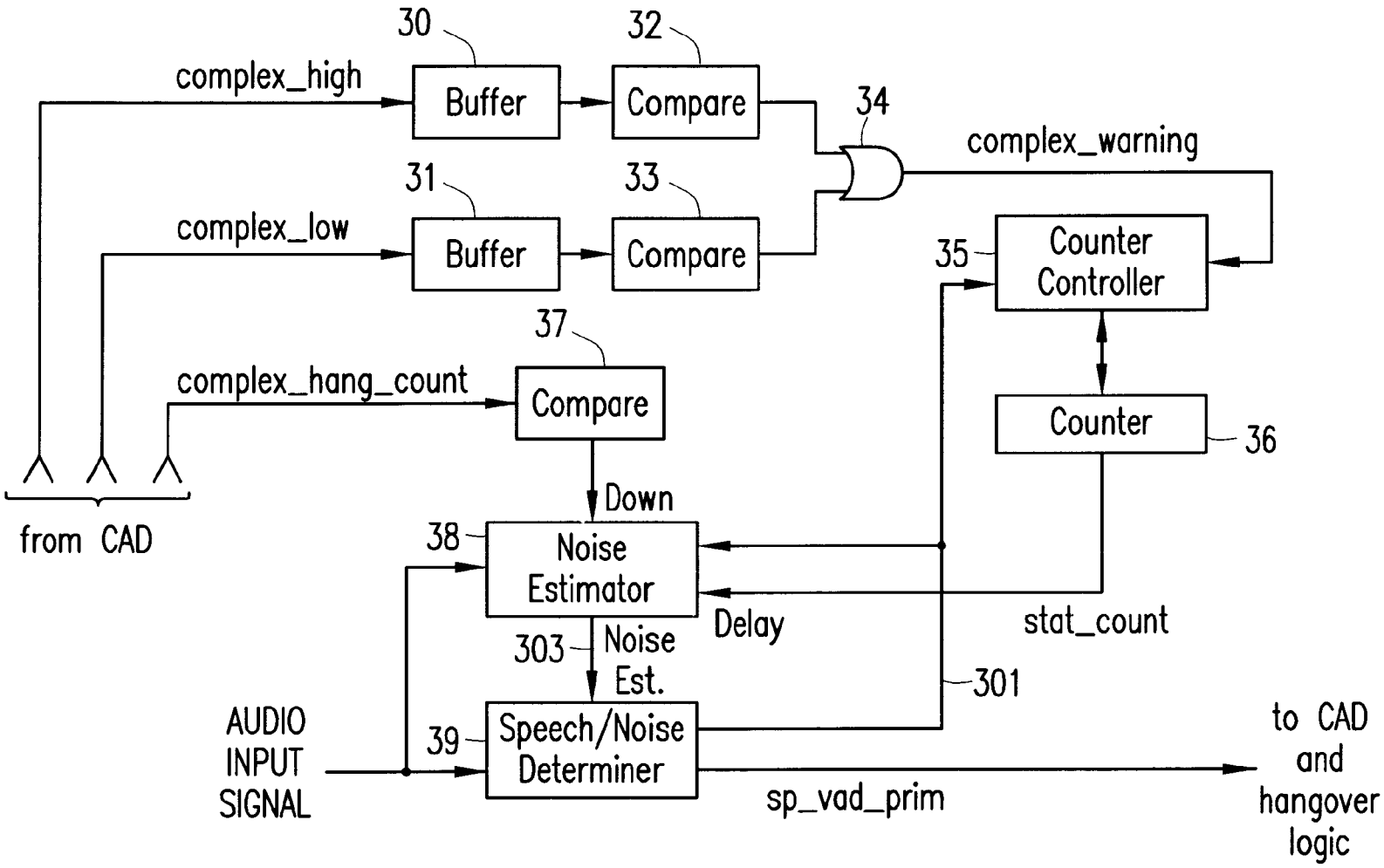
FIG. 3 illustrates exemplary embodiments of the voice activity detector of FIG. 1.

FIG. 3 illustrates pertinent portions of exemplary embodiments of the VAD of FIG. 1. As described above with respect to FIG. 2, the VAD receives from the CAD signal relevancy parameters complex_high, complex_low and complex_hang_count. Complex_high and complex_low are input to respective buffers 30 and 31, whose outputs are respectively coupled to comparators 32 and 33. The outputs of the comparators 32 and 33 are coupled to respective inputs of an OR gate 34 which outputs a complex_warning signal to a counter controller 35. The counter controller 35 controls a counter 36 in response to the complex_warning signal.

The audio input signal is coupled to an input of a noise estimator 38 and is also coupled to an input of a speech/noise determiner 39. The speech/noise determiner 39 also receives from noise estimator 38 an estimate 303 of the background noise, as is conventional. The speech/noise determiner is conventionally responsive to the input audio signal and the noise estimate information at 303 to produce the speech/noise indication sp_vad_prim, which is provided to the CAD and the hangover logic of FIG. 1. The signal complex_hang_count is input to a comparator 37 whose output is coupled to a DOWN input of the noise estimator 38. When the DOWN input is activated, the noise estimator is only permitted to update its noise estimate downwardly or leave it unchanged, that is, any new estimate of the noise must indicate less noise than, or the same noise as, the previous estimate. In other embodiments, activation of the DOWN input permits the noise estimator to update its estimate upwardly to indicate more noise, but requires the speed (strength) of the update to be significantly reduced.

The noise estimator 38 also has a DELAY input coupled to an output signal produced by the counter 26, namely stat_count. Noise estimators in conventional VADs typically implement a delay period after receiving an indication that the input signal is, for example, non-stationary or a pitched or tone signal. During this delay period, the noise estimate cannot be updated to a higher value. This helps to prevent erroneous responses to non-noise signals hidden in the noise or voiced stationary signals. When the delay period expires, the noise estimator may update its noise estimates upwardly, even if speech has been indicated for awhile. This keeps the overall VAD algorithm from locking to an activity indication if the noise level suddenly increases.

The DELAY input is driven by stat_count according to the invention to set a lower limit on the aforementioned delay period of the noise estimator (i.e., require a longer delay than would otherwise be required conventionally) when the signal seems to be too relevant to permit a "quick" increase of the noise estimate. The stat_count signal can delay the increase of the noise estimate for quite a long time (e.g., 5 seconds) if very high relevancy has been detected by the CAD for a rather long time (e.g., 2 seconds). In one embodiment, stat_count is used to reduce the speed (strength) of the noise estimate updates where higher relevancy is indicated by the CAD.

The speech/noise determiner 39 has an output 301 coupled to an input of the counter controller 35, and also coupled to the noise estimator 38, this latter coupling being conventional. When the speech/noise determiner determines that a given frame of the audio input signal is, for example, a pitched signal or a tone signal or a non-stationary signal, the output 301 indicates this to counter controller 35, which in turn sets the output stat_count of counter 36 to a desired value. If output 301 indicates a stationary signal, controller 35 can decrement counter 36.

Figure 4:
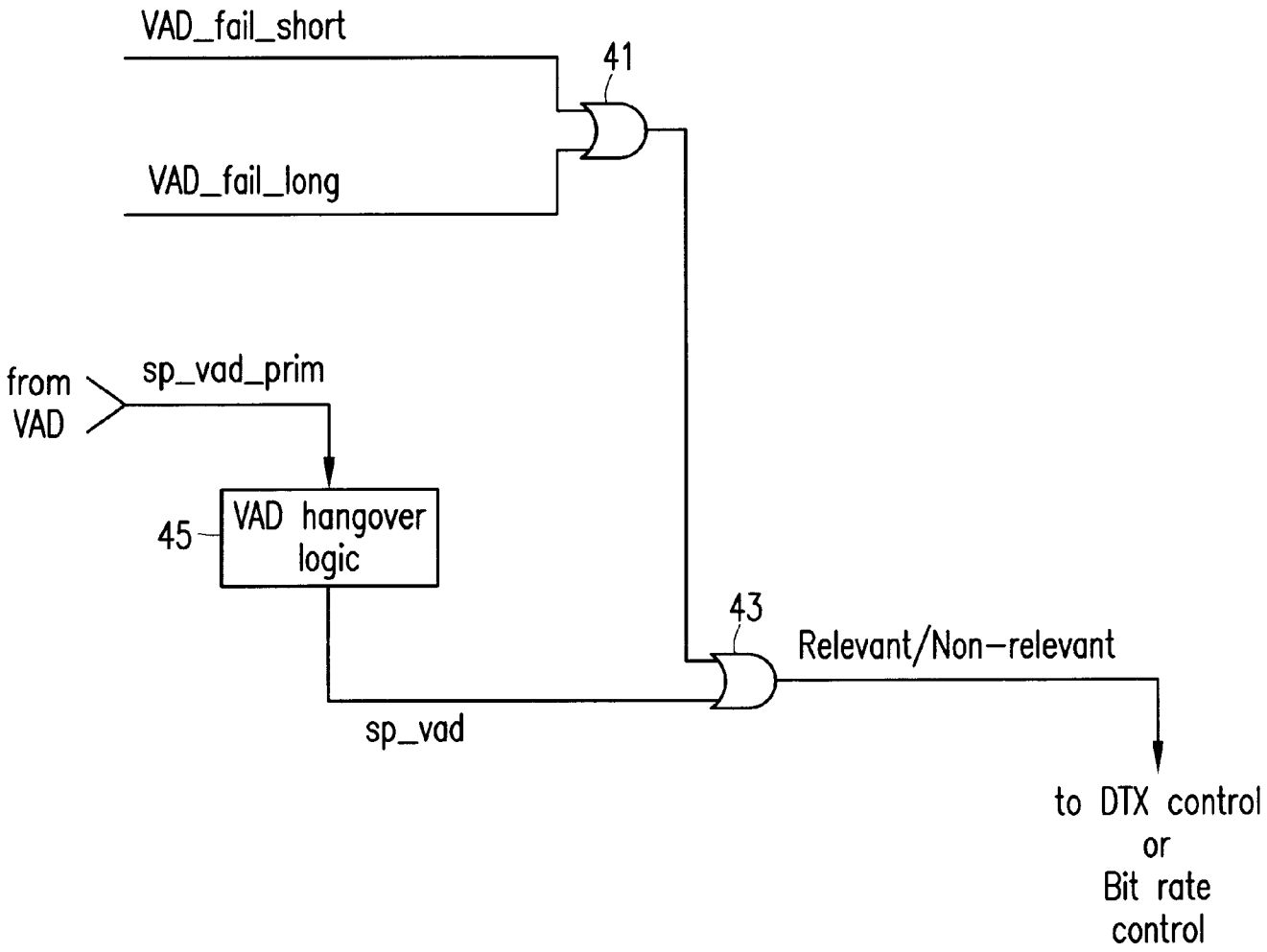
FIG. 4 illustrates exemplary embodiments of the hangover logic of FIG. 1.

FIG. 4 illustrates an exemplary embodiment of the hangover logic of FIG. 1. In FIG. 4, the complex signal flags VAD_fail_short and VAD_fail_long are input to an OR gate 41 whose output drives an input of another OR gate 43. The speech/noise indication sp_vad_prim from the VAD is input to conventional VAD hangover logic 45. The output sp_vad of the VAD hangover logic is coupled to a second input of OR gate 43. If either of the complex signal flags VAD_fail_short or VAD_fail_long is active, then the output of OR gate 41 will cause the OR gate 43 to indicate that the input signal is relevant.

If neither of the complex signal flags is active, then the speech/noise decision of the VAD hangover logic 45, namely the signal sp_vad, will constitute the relevant/non-relevant indication. If sp_vad is active, thereby indicating speech, then the output of OR gate 43 indicates that the signal is relevant. Otherwise, if sp_vad is inactive, indicating noise, then the output of OR gate 43 indicates that the signal is not relevant. The relevant/non-relevant indication from OR gate 43 can be provided, for example, to the DTX control section of a DTX system, or to the bit rate control section of a VR system.

Figure 5:
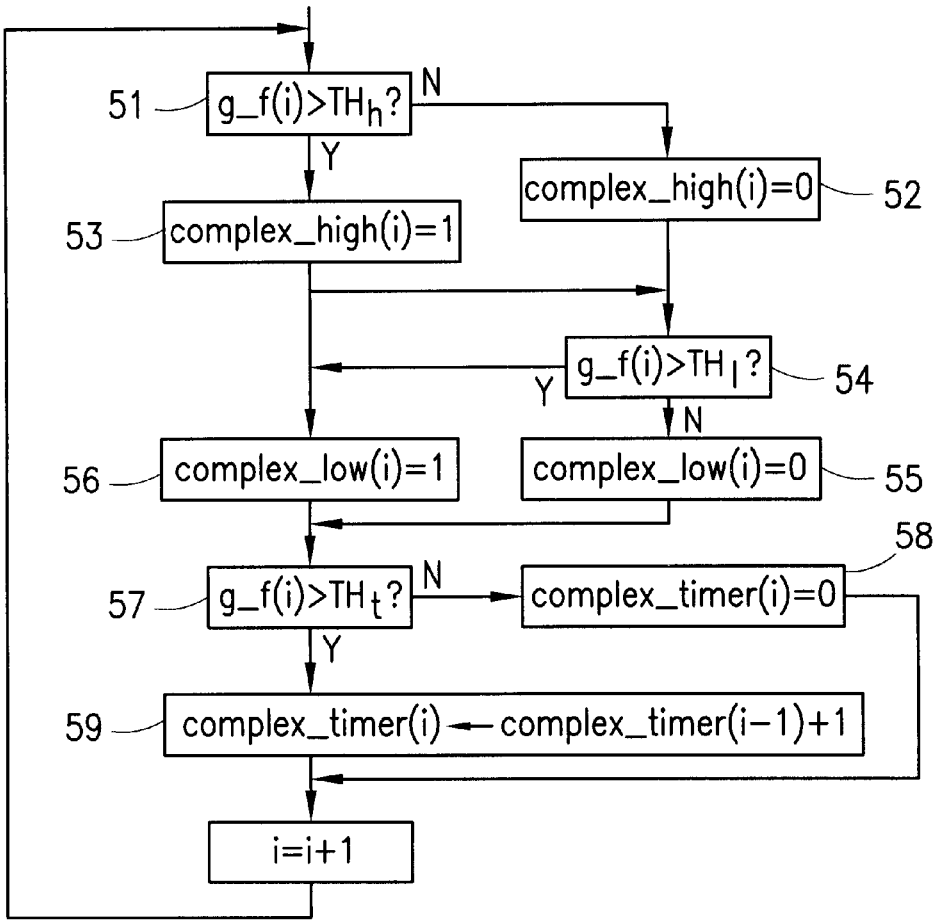
FIG. 5 illustrates exemplary operations of the parameter generator of FIG. 2.

FIG. 5 illustrates exemplary operations which can be performed by the parameter generator 28 of FIG. 2 to produce the signals complex_high, complex_low and complex_timer. The index i in FIG. 5 (and in FIGS. 6–11) designates the current frame of the audio input signal. As shown in FIG. 5, each of the aforementioned signals has a value of 0 if the signal g_f(i) does not exceed a respective threshold value, namely $TH_h$ for complex_high at 51–52, $TH_l$ for complex_low at 54–55, or $TH_t$ for complex_timer at 57–58. If g_f(i) exceeds threshold $TH_h$ at 51, then complex_high is set to 1 at 53, and if g_f(i) exceeds threshold $TH_l$ at 54, then complex_low is set to 1 at 56. If g_f(i) exceeds threshold $TH_t$ at 57, then complex_timer is incremented by 1 at 59. Exemplary threshold values in FIG. 5 include $TH_h$=0.6, $TH_l$=0.5, and $TH_t$=0.7. It can be seen from FIG. 5 that complex_timer represents the number of consecutive frames in which g_f(i) is greater than $TH_t$.

Figure 6:
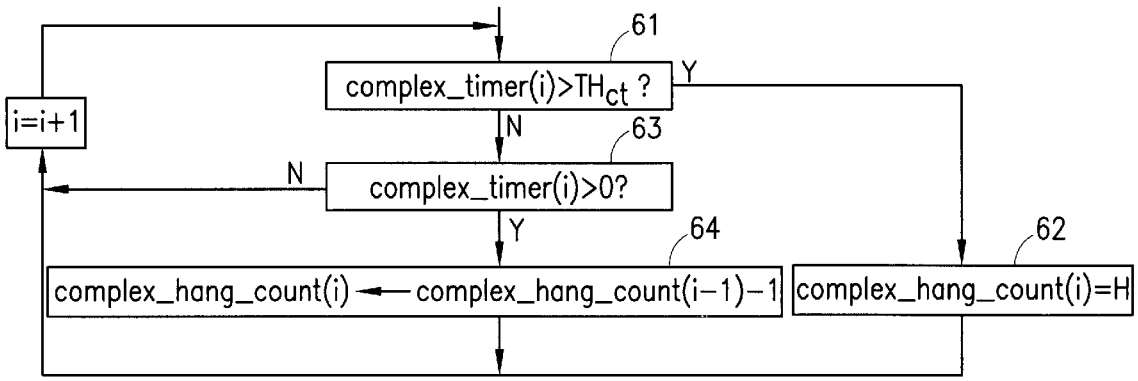
FIG. 6 illustrates exemplary operations of the counter controller of FIG. 2.

FIG. 6 illustrates exemplary operations which can be performed by the counter controller 29 and the counter 201 of FIG. 2. If complex_timer exceeds a threshold value $TH_{ct}$ at 61, then the counter controller 29 sets the output complex_hang_count of counter 201 to a value H at 62. If complex_timer does not exceed the threshold $TH_{ct}$ at 61, but is greater than 0 at 63, then the counter controller 29 decrements the output complex_hang_count of counter 201 at 64. Exemplary values in FIG. 6 include $TH_{ct}$=100 (corresponding to 2 seconds in one embodiment), and H=250 (corresponding to 5 seconds in one embodiment).

Figure 7:
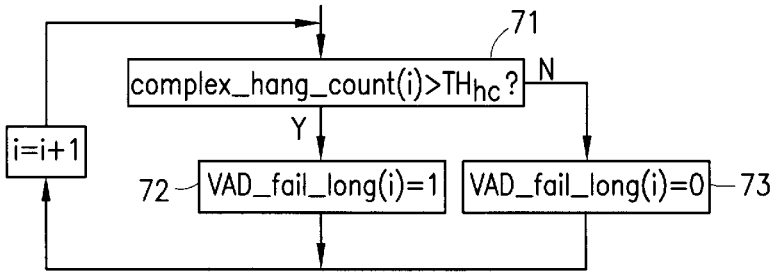
FIG. 7 illustrates exemplary operations of a portion of FIG. 2.

FIG. 7 illustrates exemplary operations which can be performed by the comparator 203 of FIG. 2. If complex_hang_count is greater than $TH_{hc}$ at 71, then VAD_fail_long is set to 1 at 72. Otherwise, VAD_fail_long is set to 0 at 73. In one embodiment, $TH_{hc}$=0.

Figure 8:
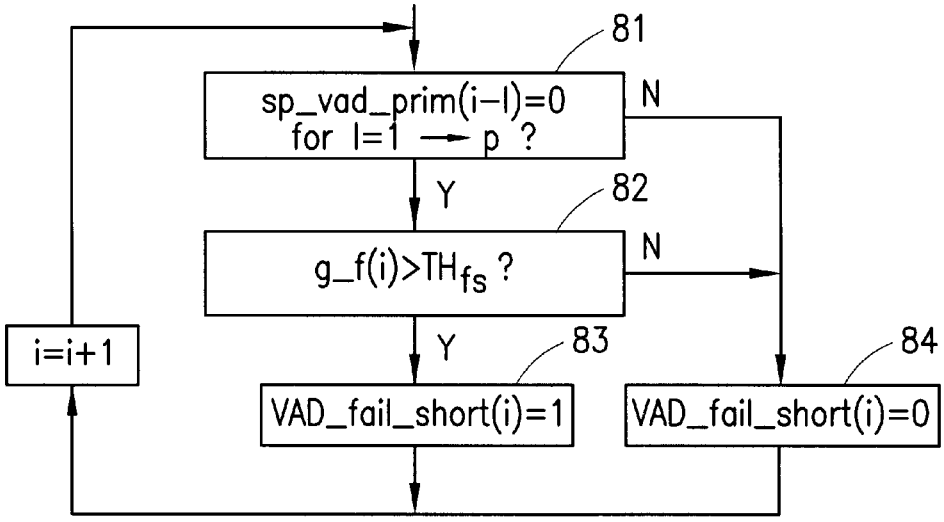
FIG. 8 illustrates exemplary operations of another portion of FIG. 2.

FIG. 8 illustrates exemplary operations which can be performed by the buffer 202, comparators 204 and 205, and the AND gate 207 of FIG. 2. As shown in FIG. 8, if the last p values of sp_vad_prim immediately preceding the present (ith) value of sp_vad_prim are all equal to 0 at 81, and if g_f(i) exceeds a threshold value $TH_{fs}$ at 82, then VAD_fail_short is set to 1 at 83. Otherwise, VAD_fail_short is set to 0 at 84. Exemplary values in FIG. 8 include $TH_{fs}$=0.55, and p=10.

Figure 9:
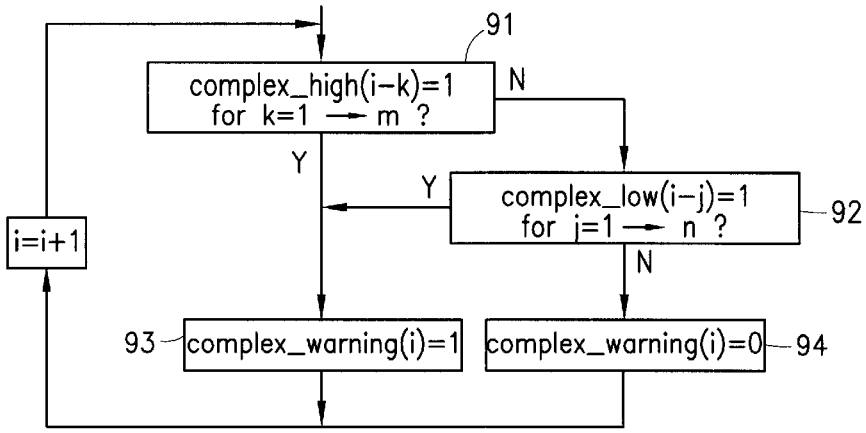
FIG. 9 illustrates exemplary operations of a portion of FIG. 3.

FIG. 9 illustrates exemplary operations which can be performed by the buffers 30 and 31, the comparators 32 and 33, and the OR gate 34 of FIG. 3. If the last m values of complex_high immediately preceding the current (ith) value of complex_high are all equal to 1 at 91, or if the last n values of complex_low immediately preceding the current (ith) value of complex_low are all equal to 1 at 92, then complex_warning is set to 1 at 93. Otherwise, complex_warning is set to 0 at 94. Example values in FIG. 9 include m=8 and n=15.

Figure 10:
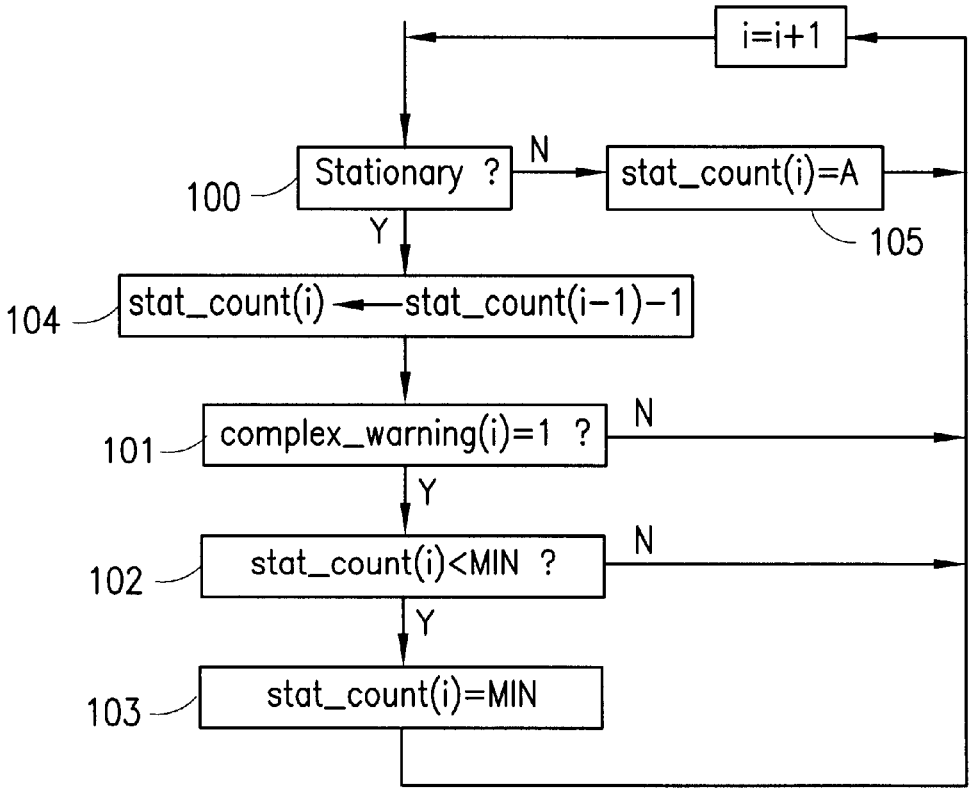
FIG. 10 illustrates exemplary operations of the counter controller of FIG. 3.

FIG. 10 illustrates exemplary operations which can be performed by the counter controller 35 and the counter 36 of FIG. 3. If the audio signal is indicated to be stationary at 100 (see 301 of FIG. 3), then stat_count is decremented at 104. Then, if complex_warning=1 at 101, and if stat_count is less than a value MIN at 102, then stat_count is set to MIN at 103. If the audio signal is not stationary at 100, then stat_count is set to A at 105. Exemplary values of MIN and A are 5 and 20, respectively, which would, in one embodiment, result in low-limiting the delay value of noise estimator 38 (FIG. 3) to 100 ms and 400 ms, respectively.

Figure 11:
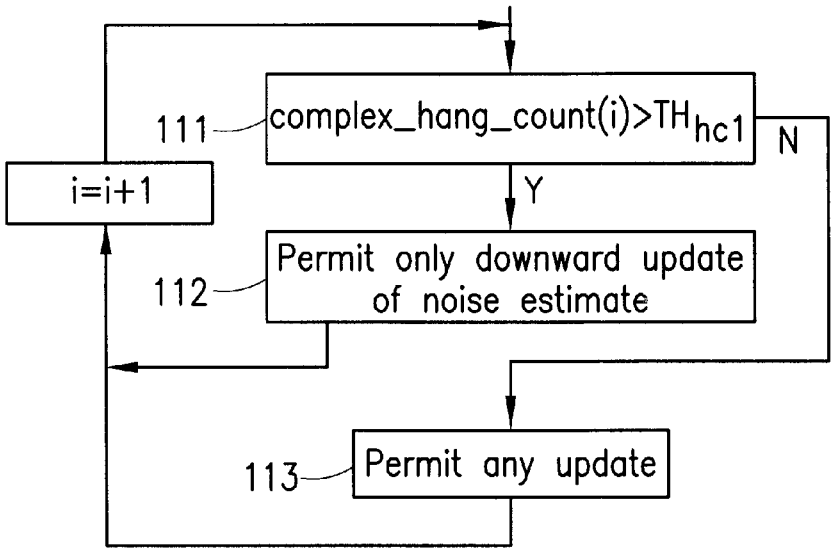
FIG. 11 illustrates exemplary operations of a further portion of FIG. 3.

FIG. 11 illustrates exemplary operations which can be performed by the comparator 37 and noise estimator 38 of FIG. 3. If complex_hang_count exceeds a threshold value $TH_{hc}$ at 111, then at 112 the comparator 37 drives the DOWN input of noise estimator 38 active such that the noise estimator 38 is only permitted to update its noise estimates in a downward direction (or leave them unchanged). If complex_hang_count does not exceed the threshold $TH_{hcl}$ at 111, then the DOWN input of noise estimator 38 is inactive, so the noise estimator 38 is permitted at 113 to make upward or downward updates of its noise estimate. In one example, $TH_{hcl}$=0.

As demonstrated above, the complex signal flags generated by the CAD permit a "noise" classification by the VAD to be selectively overridden if the CAD determines that the input audio signal is a complex signal that includes information that is perceptually relevant to the listener. The VAD_fail_short flag triggers a "relevant" indication at the output of the hangover logic when g_f(i) is determined to exceed a predetermined value after a predetermined number of consecutive frames have been classified as noise by the VAD.

Also, the VAD_fail_long flag can trigger a "relevant" indication at the output of the hangover logic, and can maintain this indication for a relatively long maintaining period of time after g_f(i) has exceeded a predetermined value for a predetermined number of consecutive frames. This maintaining period of time can encompass several separate sequences of consecutive frames wherein g_f(i) exceeds the aforementioned predetermined value but wherein each of the separate sequences of consecutive frames comprises less than the aforementioned predetermined number of frames.

In one embodiment, the signal relevancy parameter complex_hang_count can cause the DOWN input of noise estimator 38 to be active under the same conditions as is the complex signal flag VAD_fail_long. The signal relevancy parameters complex_high and complex_low can operate such that, if g_f(i) exceeds a first predetermined threshold for a first number of consecutive frames or exceeds a second predetermined threshold for a second number of consecutive frames, then the DELAY input of the noise estimator 38 can be raised (as needed) to a lower limit value, even if several consecutive frames have been determined (by the speech/noise determiner 39) to be stationary.

Figure 12:
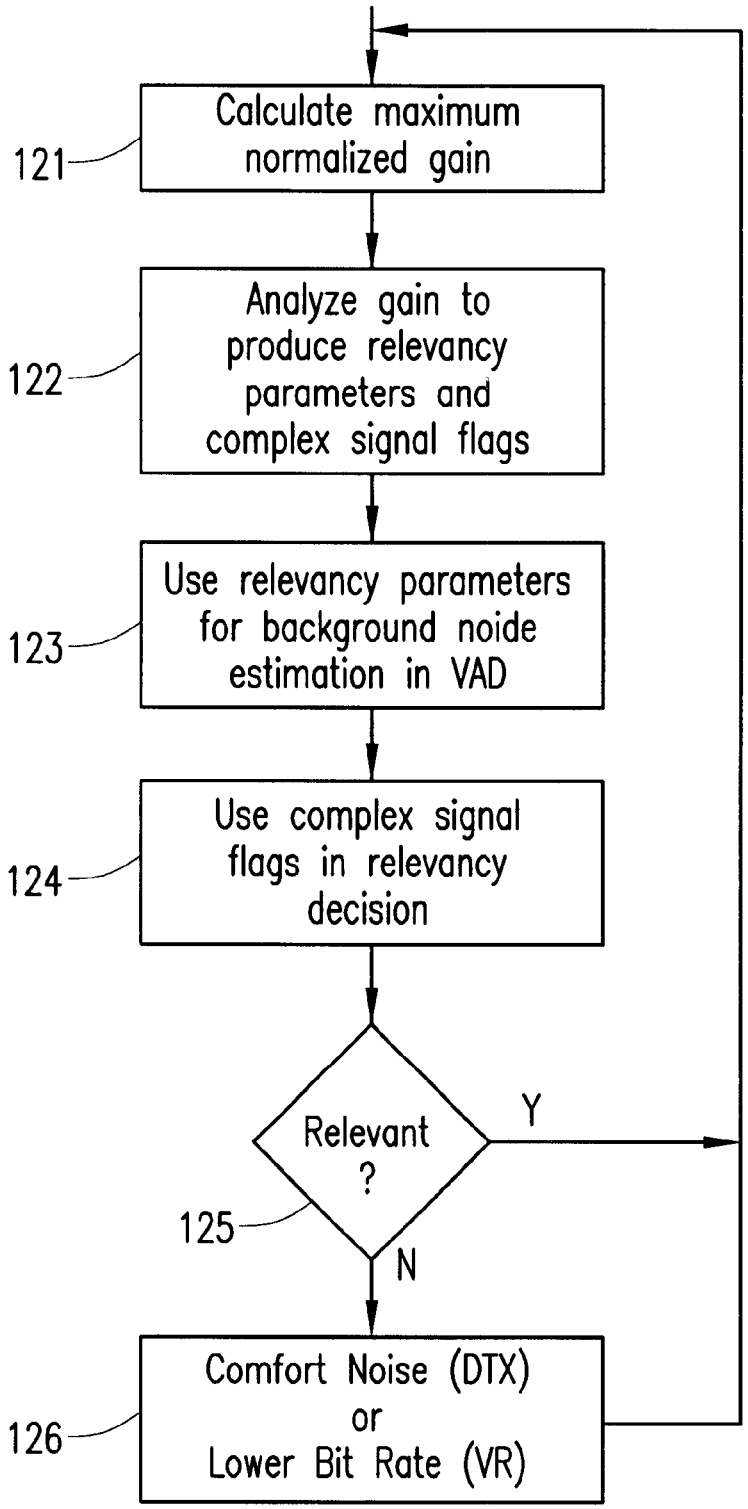
FIG. 12 illustrates exemplary operations which can be performed by the embodiments of FIGS. 1–11.

FIG. 12 illustrates exemplary operations which can be performed by the speech encoder embodiments of FIGS. 1–11. At 121, the normalized gain having the largest (maximum) magnitude for the current frame is calculated. At 122, the gain is analyzed to produce the relevancy parameters and complex signal flags. At 123, the relevancy parameters are used for background noise estimation in the VAD. At 124, the complex signal flags are used in the relevancy decision of the hangover logic. If it is determined at 125 that the audio signal does not contain perceptually relevant information, then at 126 the bit rate can be lowered, for example, in a VR system, or comfort noise parameters can be encoded, for example, in a DTX system.

From the foregoing description, it will be evident to workers in the art that the embodiments of FIGS. 1–13 can be readily implemented by suitable modifications in software, hardware, or both, in a conventional speech encoding apparatus.

Although exemplary embodiments of the present invention have been described above in detail, this does not limit the scope of the invention, which can be practiced in a variety of embodiments.

What is claimed is:

1. A method of preserving perceptually relevant non-speech information in an audio signal during encoding of the audio signal, comprising:

making a first determination of whether the audio signal is considered to comprise speech or noise information;

making a second determination of whether the audio signal includes non-speech information that is perceptually relevant to a listener; and selectively overriding said first determination in response to said second determination.

2. The method of claim 1, wherein said step of making said second determination includes the additional steps of:

determining, from the audio signal, correlation values using an open-loop long term prediction correlation analysis; and comparing a predetermined value to the correlation values associated with respective frames into which the audio signal is divided.

3. The method of claim 2, wherein said selectively overriding step includes overriding said first determination in response to a correlation value exceeding the predetermined value.

4. The method of claim 2, wherein said selectively overriding step includes overriding said first determination in response to a predetermined number of correlation values in a given time period exceeding the predetermined value.

5. The method of claim 4, wherein said selectively overriding step includes overriding said first determination in response to a predetermined number of consecutive correlation values exceeding the predetermined value.

6. The method of claim 2, including, for each said frame, finding a highest normalized correlation value of a high pass filtered version of the audio signal, said highest normalized correlation values respectively corresponding to said first-mentioned correlation values.

7. The method of claim 6, wherein said finding step includes, for each of the frames, finding a largest-magnitude normalized correlation value.

8. The method of claim 1, wherein said selectively overriding step includes overriding a first determination of noise in response to a second determination of perceptually relevant non-speech information.

9. A method of preserving perceptually relevant information in an audio signal, comprising:

for each of a plurality of frames into which the audio signal is divided, finding a highest normalized correlation value of a high pass filter version of the audio signal by using an open-loop long term prediction correlation analysis;

producing a first sequence of said normalized correlation values;

determining a second sequence of representative values to represent respectively the normalized correlation values of the fist sequence; and comparing the representative values to a threshold value to obtain an indication of whether the audio signal contains perceptually relevant non-speech information.

10. The method of claim 9, wherein said finding step includes applying correlation analysis to the audio signal without producing the high pass filtered version of the audio signal.

11. The method of claim 9, wherein said finding step includes high pass filtering the audio signal and thereafter applying correlation analysis to the high pass filtered audio signal.

12. The method of claim 9, wherein said finding step includes, for each of the frames, finding a largest-magnitude normalized correlation value.

13. An apparatus for use in an audio signal encoder to preserve perceptually relative non-speech information contained in an audio signal, comprising:

a classifier for receiving the audio signal and making a first determination of whether the audio signal is considered to comprise speech or noise information;

a detector for receiving the audio signal and making a second determination of whether the audio signal includes non-speech information that is perceptually relevant to a listener; and logic coupled to said classifier and said detector, said logic having an output for indicating whether the audio signal includes perceptually relevant information, said logic operable to selectively provide at said output information indicative of said first determination, and also responsive to said second determination for selectively overriding at said output said information indicative of said first determination.

14. The apparatus of claim 13, wherein said detector is operable for comparing a predetermined value to correlation values associated with respective frames into which the audio signal is divided.

15. The apparatus of claim 14, wherein said logic is operable for overriding said information indicative of said first determination in response to a correlation value exceeding the predetermined value.

16. The apparatus of claim 14, wherein said logic is operable for overriding said information indicative of said first determination in response to a predetermined number of correlation values in a given time period exceeding the predetermined value.

17. The apparatus of claim 16, wherein said logic is operable for overriding said information indicative of said first determination in response to a predetermined number of consecutive correlation values associated with timewise consecutive frames exceeding the predetermined value.

18. The apparatus of claim 14, wherein said detector is operable for finding within each of said frames a highest normalized correlation value of a high pass filtered version of the audio signal, said highest normalized correlation values corresponding respectively to said first-mentioned correlation values.

19. The apparatus of claim 18, wherein each of said highest normalized correlation values represents a largest-magnitude normalized correlation value within the associated frame.

20. The apparatus of claim 13, wherein said logic is operable for overriding information indicative of a noise determination in response to said second determination indicating perceptually relevant non-speech information.

* * * * *

UNITED STATES PATENT AND TRADEMARK OFFICE

CERTIFICATE OF CORRECTION

PATENT NO. : 6,424,938 B1
DATED : July 23, 2002
INVENTOR(S) : Ingemar Johansson et al.

It is certified that error appears in the above-identified patent and that said Letters Patent is hereby corrected as shown below:

Column 7,
Line 56, replace "counter 26" with -- counter 36 --

Column 11,
Line 21, replace "high pass filter version" with -- high pass filtered version --
Line 28, replace "first sequence" with -- first sequence --

Column 12,
Line 17, after "after divided" add -- , and wherein said correlation values are determined by open-loop long term prediction correlation analysis --

Signed and Sealed this

Fifth Day of November, 2002

*Attest:*

*Attesting Officer*

JAMES E. ROGAN
*Director of the United States Patent and Trademark Office*